US009470013B2

(12) United States Patent
Munyon

(10) Patent No.: US 9,470,013 B2
(45) Date of Patent: Oct. 18, 2016

(54) ADJUSTABLE RAILING

(71) Applicant: Collins Limited, LLC, Somers Point, NJ (US)

(72) Inventor: John M. Munyon, Millville, NJ (US)

(73) Assignee: COLLINS LIMITED, LLC, Somers Point, NJ (US)

( * ) Notice: Subject to any disclaimer, the term of this patent is extended or adjusted under 35 U.S.C. 154(b) by 565 days.

(21) Appl. No.: 13/847,010

(22) Filed: Mar. 19, 2013

(65) Prior Publication Data

US 2013/0277634 A1 Oct. 24, 2013

Related U.S. Application Data

(60) Provisional application No. 61/612,551, filed on Mar. 19, 2012.

(51) Int. Cl.
*E04H 17/14* (2006.01)
*E04F 11/18* (2006.01)

(52) U.S. Cl.
CPC ..... *E04H 17/1421* (2013.01); *E04F 11/1817* (2013.01); *E04F 2011/1819* (2013.01); *E04F 2011/1821* (2013.01)

(58) Field of Classification Search
CPC ..... E04F 11/1817; E04F 2011/1819; E04F 2011/1821; E04H 17/1421
USPC ..... 256/22, 64, 65.01, 65.02, 65.11, 67, 69; 52/182, 183
See application file for complete search history.

(56) References Cited

U.S. PATENT DOCUMENTS

| | | | | |
|---|---|---|---|---|
| 1,416,957 | A | 5/1922 | Hughes | |
| 1,663,203 | A * | 3/1928 | Luipersbek | 403/77 |
| 2,715,513 | A | 8/1955 | Kools | |
| 3,306,586 | A * | 2/1967 | Green | 256/73 |
| 3,733,055 | A | 5/1973 | Hughes, Jr. | |
| 3,942,763 | A | 3/1976 | Helterbrand et al. | |
| 3,960,367 | A | 6/1976 | Rogers | |
| 4,083,536 | A | 4/1978 | Mulitz | |
| 4,138,094 | A | 2/1979 | Thir | |
| 4,386,762 | A * | 6/1983 | Collins | 256/59 |
| 5,056,283 | A * | 10/1991 | Sapinski | 52/184 |
| 6,145,814 | A * | 11/2000 | Perrot | 256/67 |
| 6,168,126 | B1 * | 1/2001 | Stafford | 248/276.1 |

(Continued)

OTHER PUBLICATIONS

Zottola Fab, Adjustable stair railing and handrail, http://zottolafab.com, 3 pages, printed Jul. 9, 2013.

*Primary Examiner* — Daniel P Stodola
*Assistant Examiner* — Nahid Amiri
(74) *Attorney, Agent, or Firm* — Charney IP Law LLC

(57) ABSTRACT

A vertically adjustable railing having first and second elongate balusters each with a first and second ends, the balusters having a first connection elements at their first ends and second connection elements along their length. An elongate handrail is pivotally connected at its first end to the first connection element of the first baluster and pivotally connected at its second end to the first connection element of the second baluster. An elongate lower rail having a first end and a second end is pivotally connected at its first end to the second connection element of the first baluster and pivotally connected at its second end to the second connection element of the second baluster. A distance between the first end and the second connection element of the first baluster is greater than the distance between the first end and the second connection element of the second baluster.

15 Claims, 8 Drawing Sheets

(56) References Cited

U.S. PATENT DOCUMENTS

| | | | | |
|---|---|---|---|---|
| 6,752,385 | B2 | 6/2004 | Zen et al. | |
| 6,932,329 | B1 | 8/2005 | Harder | |
| 7,121,382 | B2 * | 10/2006 | Jackson | 182/204 |
| 7,178,791 | B1 * | 2/2007 | Gray et al. | 256/67 |
| 2008/0191185 | A1 * | 8/2008 | Barnes et al. | 256/67 |
| 2009/0179183 | A1 * | 7/2009 | Ferris et al. | 256/67 |

* cited by examiner

ADJUSTABLE RAILING

CROSS-REFERENCE TO RELATED APPLICATIONS

The present application claims the benefit of U.S. Provisional Application Ser. No. 61/612,551 filed Mar. 19, 2012, the disclosure of which is incorporated by reference herein.

BACKGROUND OF THE INVENTION

The present invention relates to railings, and specifically to railings that are vertically adjustable to account for various stair pitches.

General safety and indeed most building codes require that stairs have railings. In many situations such railings are constructed from wrought iron that is welded into a custom configuration specifically adapted for the staircase in question. This practice requires the skill and artistry of professional railing manufacturers, and is therefore costly and time consuming for home and business owners.

BRIEF SUMMARY OF THE INVENTION

It would therefore be advantageous to provide a railing that can be adjusted vertically for stairs of various pitches, and therefore customized in the field. This would allow for manufacture of a railing having an adjustable configuration enabling the railing to be used for stairs of virtually any pitch, resulting in great cost savings and ease of installation over fully customized railings.

In accordance with one embodiment of the present invention, an adjustable railing is provided with A vertically adjustable railing comprises an elongate first baluster having a first end and a second end, the first baluster having a first connection element at its first end and a second connection element along its length, an elongate second baluster having a first end and a second end, the second baluster having a first connection element at its first end and a second connection element along its length, an elongate handrail having a first end and second end, the handrail being pivotally connected at its first end to the first connection element of the first baluster and being pivotally connected at its second end to the first connection element of the second baluster, and an elongate lower rail having a first end and a second end, the lower rail being pivotally connected at its first end to the second connection element of the first baluster and being pivotally connected at its second end to the second connection element of the second baluster. So configured, the distance between the first end of the first baluster and the second connection element of the first baluster is greater than the distance between the first end of the second baluster and the second connection element of the second baluster.

When the first end of the first baluster is placed above the first end of the second baluster, the handrail may be generally parallel to the lower rail.

The greater distance may be greater by approximately 1 inch.

The vertically adjustable railing may further comprise retaining elements adapted to cooperate with the first connection element. The may comprise a bolt, a nut, and at least one washer.

The connection elements may comprise spaced apart plates.

The connection elements may be within the balusters.

The first baluster may further comprise at least one weep hole at the second end thereof.

The first baluster may further comprise a base plate at the second end thereof, the base plate adapted to permit attachment of the baluster to a stair.

The railing may be adapted for use on stairs having between one and four steps.

In accordance with a second embodiment of the present invention, an adjustable railing comprises a first baluster having a base and an upper extent, the first baluster including a first hinge at the upper extent and a second hinge at a point between the base and the upper extent, a second baluster having a base and an upper extent, the second baluster including a first hinge at the upper extent and a second hinge at a point between the base and the upper extent, a handrail attached at a first end thereof to the upper extent of the first baluster by the first hinge of the first baluster and attached at a second end thereof to the upper extent of the second baluster by the first hinge of the second baluster, and a lower rail attached at a first end thereof to the first baluster at the second hinge thereof and attached at a second end thereof to the second baluster at the second hinge thereof. In a first position the handrail and the lower rail are not parallel and in a second position the handrail and the lower rail are generally parallel.

The distance between first hinge and second hinge of the first baluster may be greater than the distance between the first hinge and second hinge of the second baluster. The second hinge of the first baluster may be located at least partially within the first baluster. The second hinge of the first baluster may comprise a pivot point and the pivot point may be located entirely within the first baluster. The first baluster may further comprise at least one weep hole. The adjustable railing may be adapted for use on stairs comprising no more than five steps.

BRIEF DESCRIPTION OF THE DRAWING FIGURES

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

DETAILED DESCRIPTION

Figure 1:
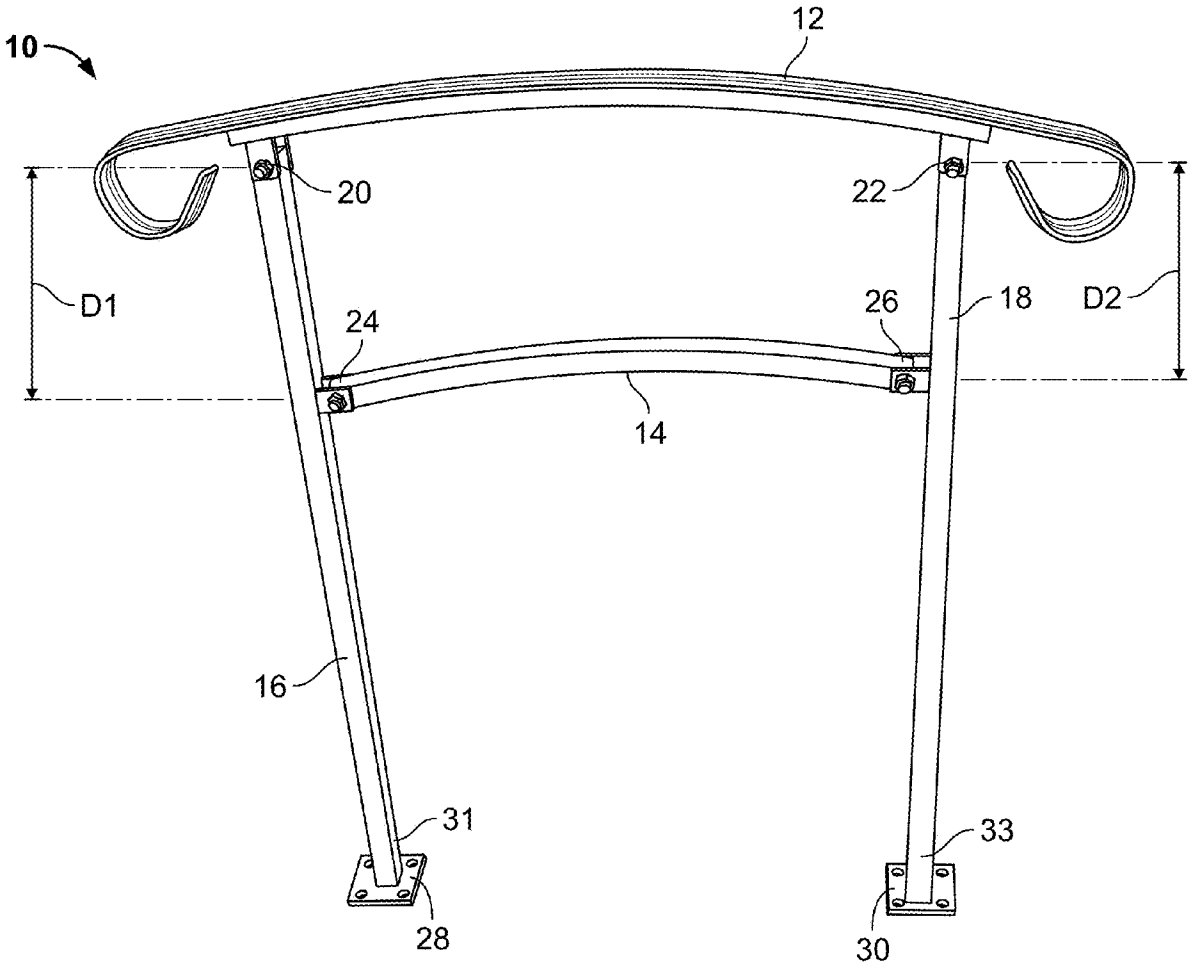
FIG. 1 depicts a perspective view of an adjustable railing in accordance with a first embodiment of the present invention, the railing situated temporarily on a flat surface.

In the following are described the preferred embodiments of the adjustable railing of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

Details of the invention may be appreciated by considering the entirety of the submission. However, in accordance with the present invention, a first embodiment of an adjustable railing is shown in FIG. 1. In this embodiment a railing 10 includes a handrail 12, a lower rail 14, and two balusters 16, 18. The two balusters 16, 18 are connected at their respective upper ends to the handrail 12 via connection elements, shown here as external hinges 20, 22, while the lower rail 14 is connected to the balusters 16, 18 at connection elements shown as external hinges 24, 26 located between the two ends of the respective baluster. It will be appreciated that external hinges have their respective pivot points outside the limits of the handrail or baluster as the case may be. Typically the hinges 24, 26 will be located just above the mid-point of the balusters 16, 18, respectively. The lower ends of each baluster may be unadorned, or may include foot plates 28, 30 or other base members for connection to a stair.

In the temporary horizontal orientation shown in FIG. 1, the handrail 12 is generally parallel to the ground while the balusters 16, 18 are generally vertical. It will be appreciated that the distance D1, between the upper end of the first baluster 16 and hinge 24, is greater than the distance D2 between the upper end of the second baluster 18 and the hinge 26. As such, the lower rail is generally not parallel to the ground in this orientation. This offset between D1 and D2 is critical to enabling the handrail 12 and lower rail 14 to become generally parallel to each other as the railing is adjusted vertically when installed on stairs. In preferred embodiments, the offset is 1 inch while D1 is 10 inches and D2 is 9 inches. In other embodiments the offset may be greater or less than 1 inch and the dimensions D1, D2 may be greater or less than 10 inches and 9 inches respectively.

Figure 2:
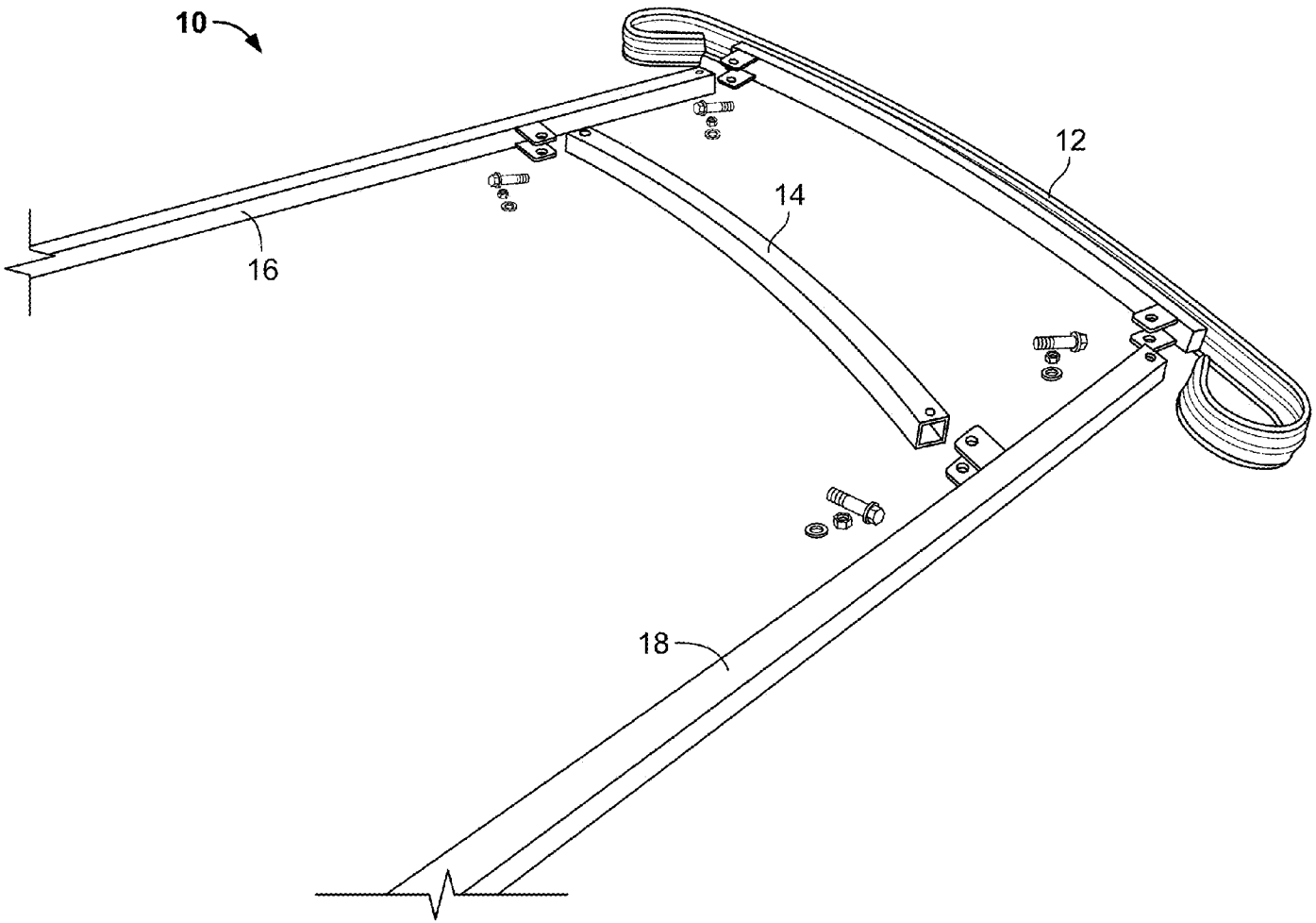
FIG. 2 depicts an exploded view of a portion of the adjustable railing of FIG. 1.
Figure 3:
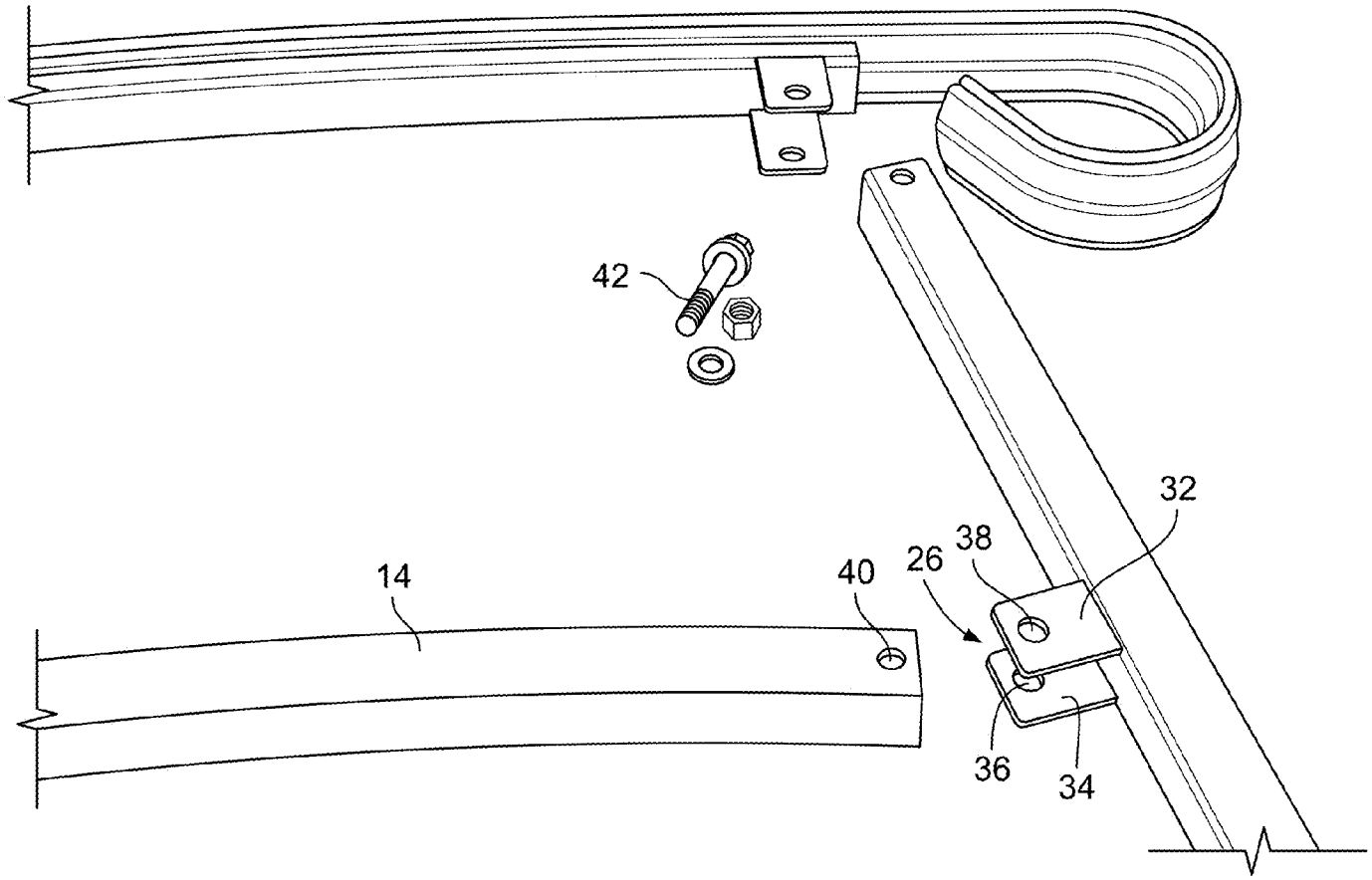
FIG. 3 depicts an exploded view of a second portion of the adjustable railing of FIG. 1.

FIG. 2 depicts an exploded perspective view of a portion of the railing 10 of FIG. 1 while FIG. 3 depicts a perspective view of a second portion of the railing 10 of FIG. 1. As shown in FIG. 3 with respect to hinge 26, the hinges consist of spaced apart plates 32, 34 connected in this case to the baluster 18. The plates 32, 34 include apertures 36, 38 therethrough. In this case, the lower rail 14 includes a corresponding aperture 40 at its end closest to the hinge 26. When the aperture 40 of the lower rail 14 is brought between the apertures 36, 38 of the plates 32, 34, they align such that a retaining element, for example a bolt, washer, and nut assembly 42, can be utilized in the conventional manner to affix the lower rail 14 to the baluster 18 in a pivotable arrangement. It will be appreciated that four such connections are provided, one at each hinge 20, 22, 24, 26. During installation, the four retaining elements can be hand tightened to maintain the parts in an assembled relation but allow for angling of the handrail 12 and lower rail 14 such that the railing 10 may be placed in an in-use position. For example, FIG. 4 shows a railing 10 in an in-use position with the handrail 12 and lower rail 14 angled with respect to the ground.

Figure 4:
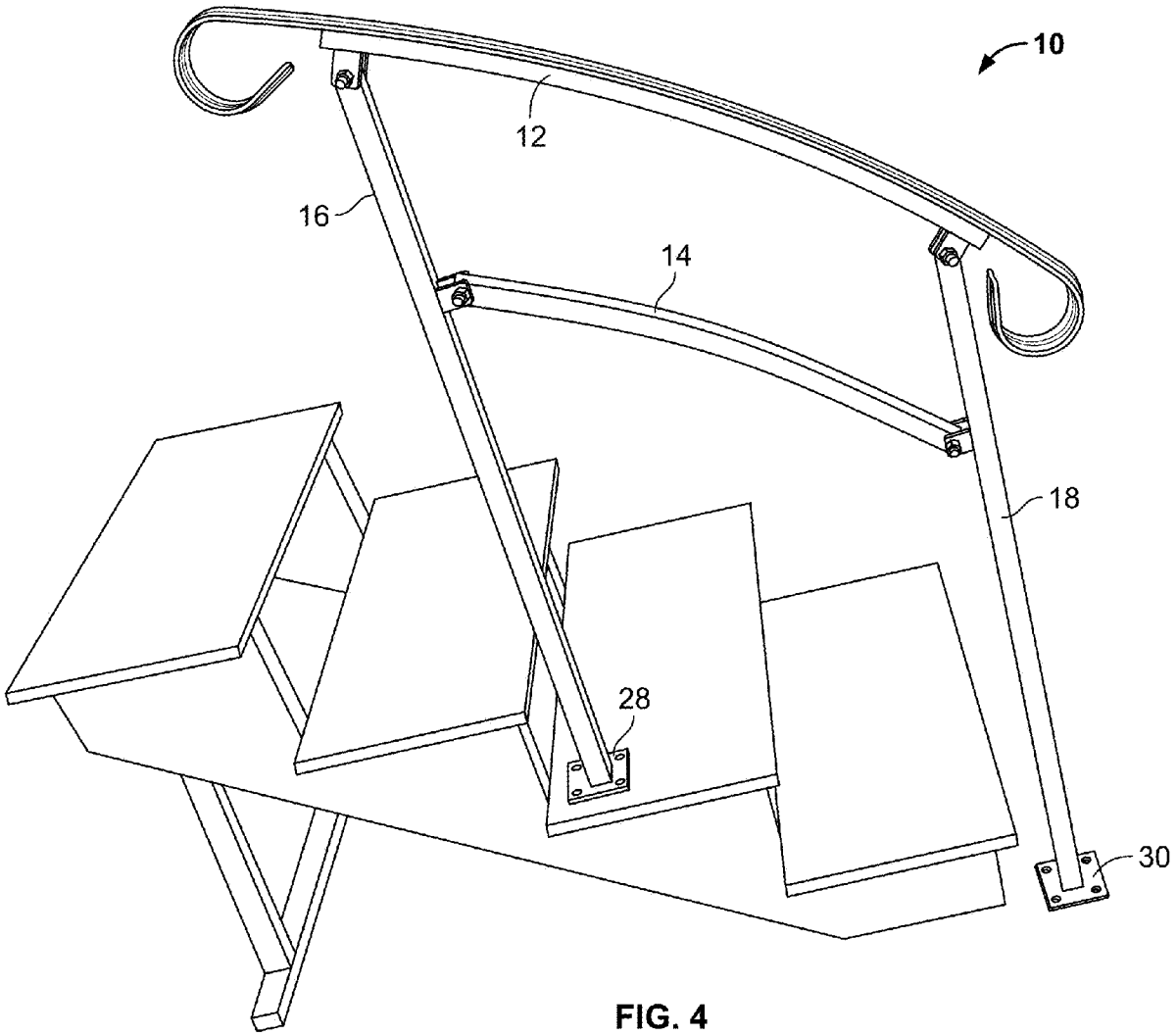
FIG. 4 depicts a perspective view of the adjustable railing of FIG. 1 installed on a representative set of stairs.

Once initially placed in the position of FIG. 4, and after ensuring that the balusters 16, 18 are vertical, the four retaining elements can all be tightened to a prescribed torque value to arrest any further movement of the railing 10. Because of the offset between D1 and D2 (FIG. 1), the handrail 12 and lower rail 14 will be parallel or generally parallel to each other for all standard stair configurations.

It will also be appreciated that the lower ends of each baluster can be affixed to the stairs in conventional means, preferably prior to tightening of the four retaining elements.

In order to maintain a universal fit, it is contemplated that the railing 10 may be provided at a standard height, that is the balusters may each be approximately 34 inches tall (making the railing approximately 36 inches tall when accounting for the handrail 12) with a range of approximately 32 inches to 38 inches. In the meantime, the railing may be provided in different lengths, preferably 2 foot, 3 foot, and 4 foot, with other lengths being possible as well. In this regard, it has been found that the maximum number of steps that may be utilized for the adjustable railing is approximately five. When creating adjustable railings in excess of those required for five stairs, stability of the adjustable railing becomes a factor. To date, stability of longer railings has been unsatisfactory.

Furthermore, although the handrail 12 shown in the figures is curved, the handrail may be provided as a straight member.

It will be appreciated that the adjustable railing shown thus far has included only one section. That is, there are provided only two balusters. In other embodiments, a third baluster may be provided. In such case, the railing will include an additional handrail and lower rail. Like those railings designed for greater than five steps, multiple section adjustable railings have stability issues. In use, it has been found that they may only be satisfactory where one section is angled along a set of stairs and a second section is oriented horizontally along a platform extending from (or extending to) the stairs.

The balusters provided herein may include weep holes 31, 33, as shown in FIG. 1. The weep holes 31, 33 are typically small holes of approximately ¼" to ½" inch diameter that permit water that may enter the baluster to escape. Such weep holes are particularly important in the second embodiment of the present invention due in part to the oversized apertures in the balusters.

In accordance with a second embodiment of the present invention, an adjustable rail may be provided with internal hinges. Representative views of such an adjustable rail are shown in FIGS. 5 and 6.

Figure 5:
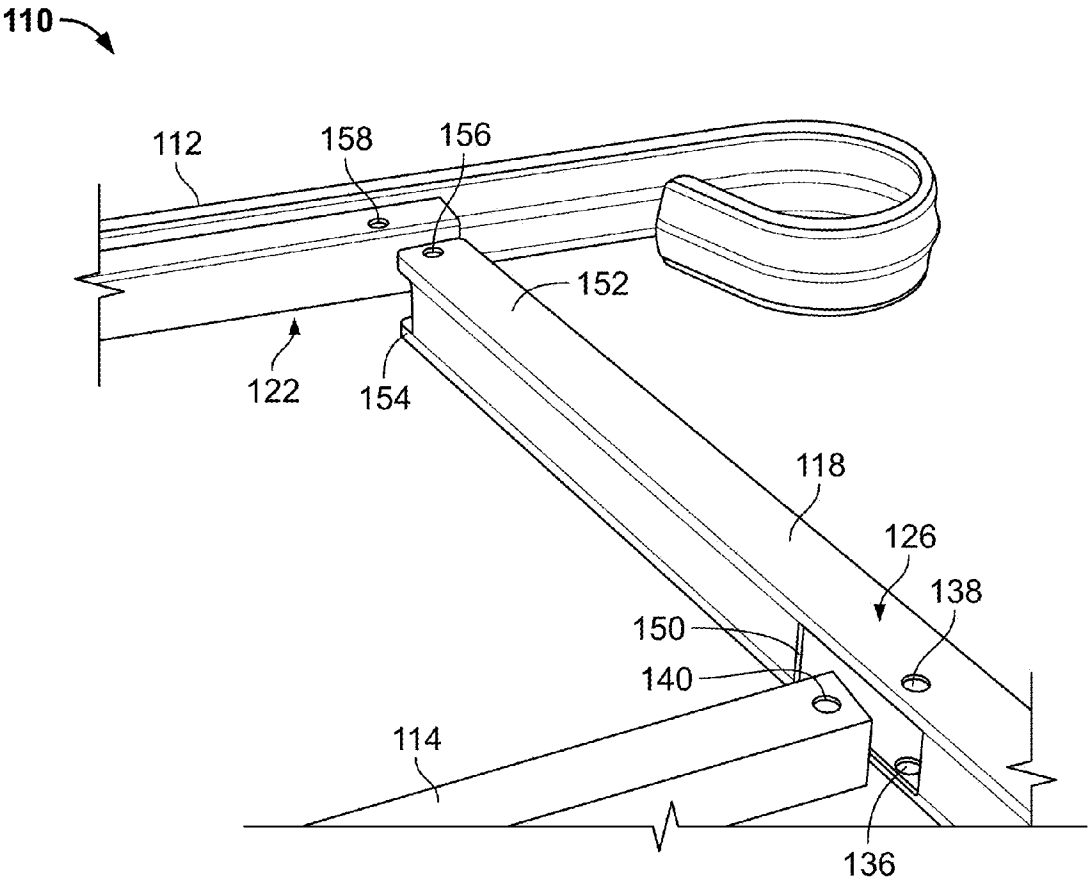
FIG. 5 depicts an exploded view of a portion of an adjustable railing in accordance with a second embodiment of the present invention.
Figure 6:
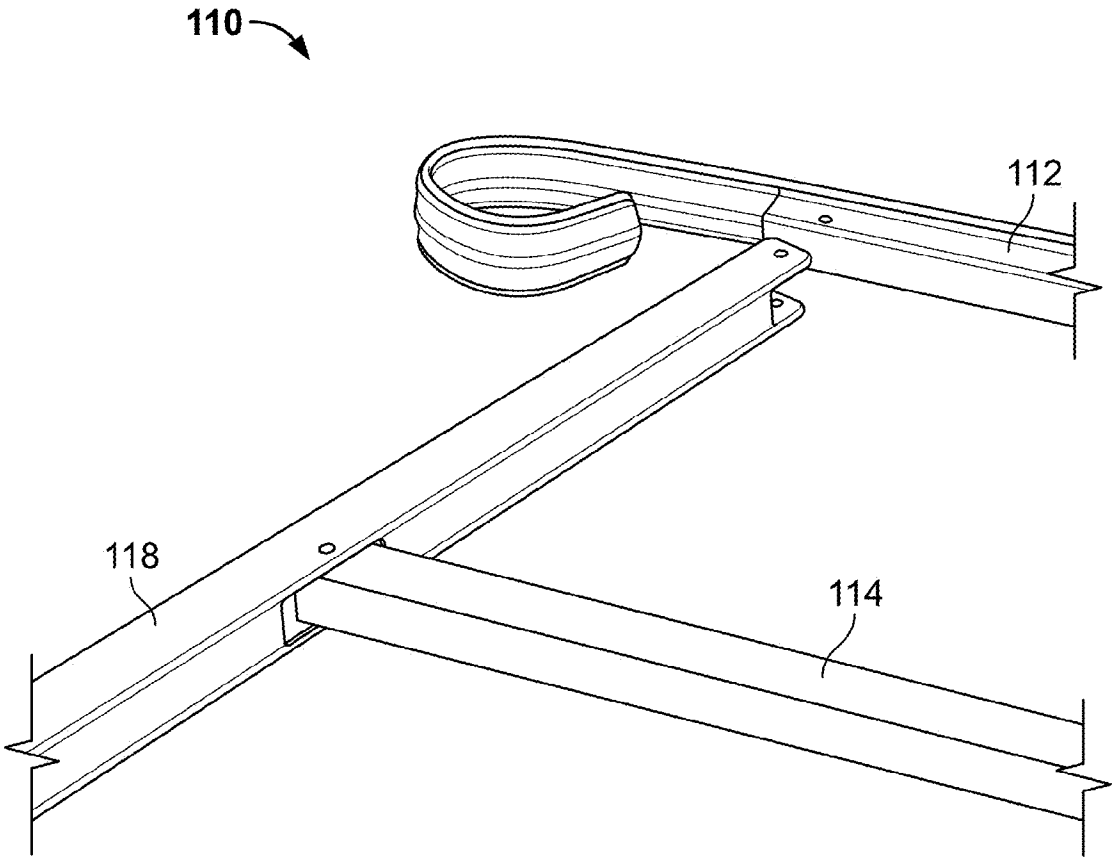
FIG. 6 depicts an exploded view of a second portion of the adjustable railing of FIG. 5.

Beginning with FIG. 5, there is shown an adjustable rail 110 of a second embodiment having a handrail 112, a lower rail 114, and a baluster 118, all arranged generally as in the first embodiment. Also provided in the second embodiment are connection element 122 for connecting the handrail 112 to the baluster 118 and connection element 126 for connecting the lower rail to the baluster 118.

It will be appreciated that in the second embodiment of the present invention the connection elements 122, 126 utilize internal hinges. That is, the pivot points of the respective connection elements are located within the handrail or baluster as the case may be. For example, the pivot point of connection element 122 is located within the handrail 112 while the pivot point of connection element 126 is located within the baluster 118.

Using the baluster 118 as an example, the connection element 126 comprises an oversized aperture 150 located on a surface of the baluster directly adjacent to the lower rail 114. This oversized aperture 150 allows entry of a portion of the lower rail 114 into the baluster 118. That portion of the lower rail 114 that enters the baluster 118 includes an aperture 140 extending therethrough. In the meantime, the baluster includes apertures 136, 138 on respective sides adjacent to the oversized aperture 150. The internal portions of these respective sides are connection elements that can be said to be within the baluster 118. Thus, when aperture 140 of the lower rail 114 is aligned with apertures 136, 138 of the baluster 118, a pin or other connection member may be fitted through the respective apertures to make a pivoting connection between the lower rail and the baluster. Other connection members include standard bolts, nuts, and washers.

In the case of the connection between the baluster 118 and the handrail 112, the physical properties of the connection are slightly different. Here, the baluster 118 includes a pair of ears, or spaced apart plates, 152, 154 arranged at the upper end thereof. Those ears 152, 154 each include an aperture, only one of which (156) is shown in FIG. 5. In the meantime, the handrail 112 includes an aperture 158. When the ears 152, 154 are placed over (or within) the handrail 112 in the area immediately adjacent to aperture 158, the apertures 156, 158 (and the one not shown) align. A connection element may then be fitted through the apertures 156, 158 (and the one not shown) to make a pivoting connection between the baluster 118 and the hand rail 112. It will be appreciated that the centerline of the connection element is entirely within the handrail 112, thus forming an interior hinge.

Figure 7:
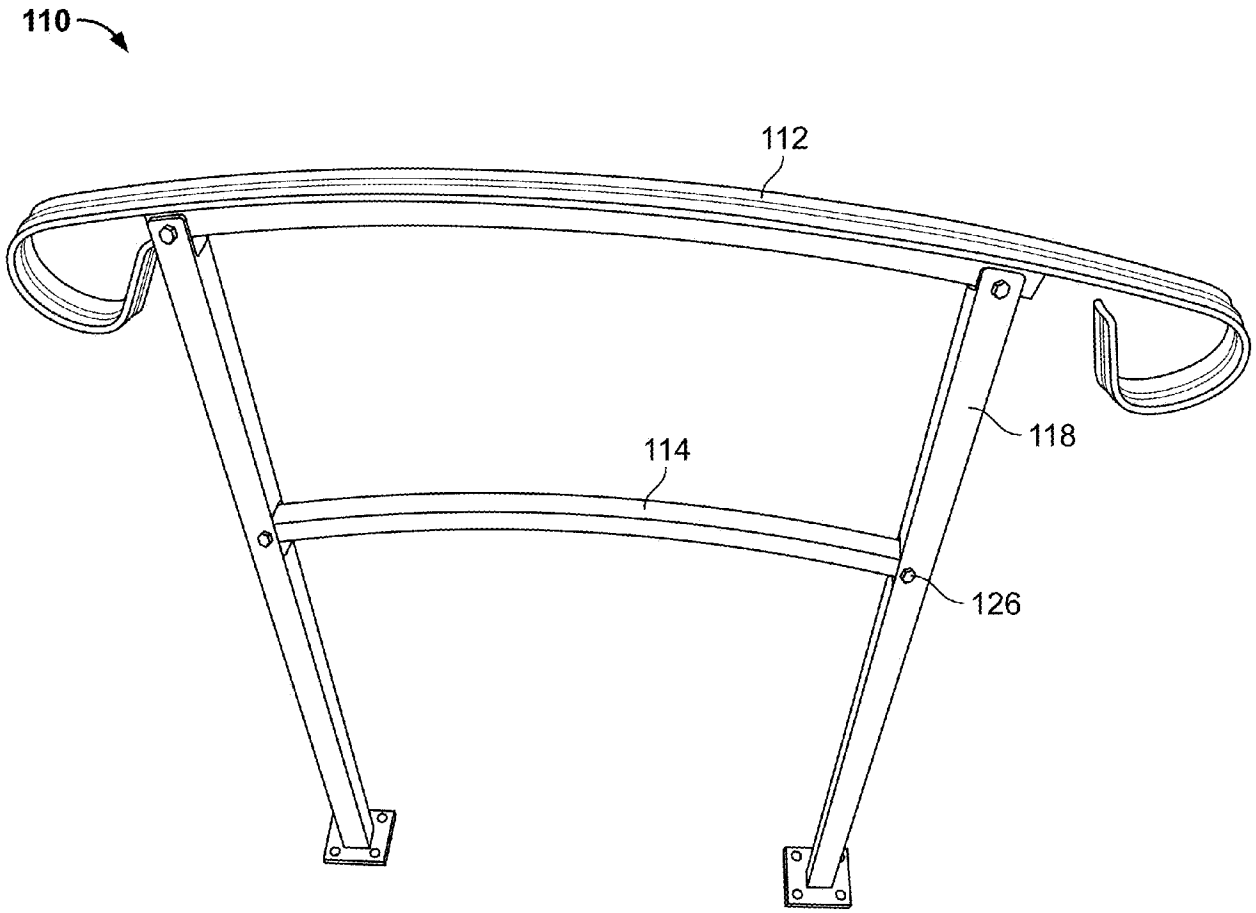
FIG. 7 depicts a perspective view of the adjustable railing of FIG. 5, the railing situated temporarily on a flat surface; and, FIG. 8 depicts a perspective view of the adjustable railing of FIG. 5 installed on a representative set of stairs.
Figure 8:
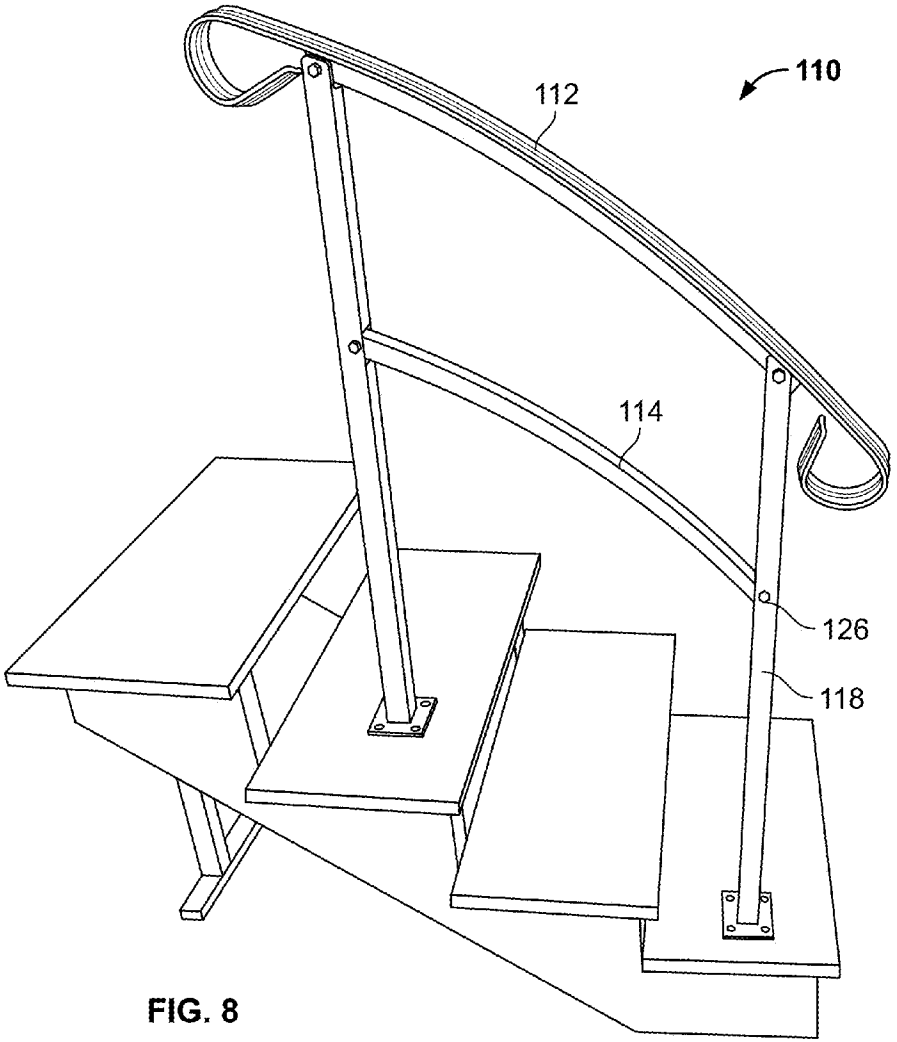

As shown in FIGS. 7 and 8, for example, the baluster 118 includes ears 152, 154 which remain external to the handrail 112. In the alternative, the ears 152, 154 may be configured internal to the handrail 112.

Although the invention herein has been described with reference to particular embodiments, it is to be understood that these embodiments are merely illustrative of the principles and applications of the present invention. It is therefore to understood that numerous modifications may be made to the illustrative embodiments and that other arrangements may be devised without departing from the spirit and scope of the present invention as defined by the appended claims.

For example, it will be appreciated that a combination of interior and exterior connection elements may be used in a single adjustable rail. One specific example is where internal connection elements may be utilized in the balusters while external connection elements are utilized in the handrail.

I claim:

1. A vertically adjustable railing, comprising:

an elongate first baluster having a first end and a second end, said first baluster having a first connection element at the first end and a second connection element along the length of the first baluster;

an elongate second baluster having a first end and a second end, said second baluster having a first connection element at the first end and a second connection element along the length of the second baluster;

an elongate handrail having a first end and second end, said handrail being pivotally connected at the first end to the first connection element of said first baluster and being pivotally connected at the second end to the first connection element of said second baluster;

an elongate lower rail having a first end and a second end, said lower rail being pivotally connected at the first end to the second connection element of said first baluster and being pivotally connected at the second end to the second connection element of said second baluster;

wherein, the distance between the first end of the first baluster and the second connection element of the first baluster is greater than the distance between the first end of the second baluster and the second connection element of the second baluster by approximately 1 inch or more.

2. The vertically adjustable railing of claim 1, wherein the greater distance is greater by approximately 1 inch.

3. The vertically adjustable railing of claim 1, further comprising retaining elements adapted to cooperate with said first connection element.

4. The vertically adjustable railing of claim 3, wherein said retaining elements comprise a bolt, a nut, and at least one washer.

5. The vertically adjustable railing of claim 1, wherein said connection elements comprise spaced apart plates.

6. The vertically adjustable railing of claim 1, wherein said connection elements are within said balusters.

7. The vertically adjustable railing of claim 1, wherein said first baluster further comprises at least one weep hole at said second end thereof.

8. The vertically adjustable railing of claim 1, wherein said first baluster further comprises a base plate at said second end thereof, said base plate adapted to permit attachment of said baluster to a stair.

9. The vertically adjustable railing of claim 1, wherein said railing is configured for use on stairs having between one and four steps.

10. An adjustable railing comprising:

a first baluster having a base and an upper extent, said first baluster including a first hinge at said upper extent and a second hinge at a point between said base and said upper extent;

a second baluster having a base and an upper extent, said second baluster including a first hinge at said upper extent and a second hinge at a point between said base and said upper extent;

a handrail attached at a first end thereof to said upper extent of said first baluster by said first hinge of said first baluster and attached at a second end thereof to said upper extent of said second baluster by said first hinge of said second baluster;

a lower rail attached at a first end thereof to said first baluster at said second hinge thereof and attached at a second end thereof to said second baluster at said second hinge thereof;

wherein said handrail and said lower rail are not parallel due to having the distance between said first hinge and said second hinge of said first baluster greater than the distance between said first hinge and second hinge of said second baluster by approximately 1 inch or more.

11. The adjustable railing of claim 10, wherein the distance between first hinge and second hinge of said first baluster is greater than the distance between said first hinge and second hinge of said second baluster by approximately 1 inch.

12. The adjustable railing of claim 11, wherein said second hinge of said first baluster is located at least partially within said first baluster.

13. The adjustable railing of claim 12, wherein said second hinge of said first baluster comprises a pivot point and said pivot point is located entirely within said first baluster.

14. The adjustable railing of claim 13, wherein said first baluster further comprises at least one weep hole.

15. The adjustable railing of claim 14, wherein said adjustable railing is configured for use on stairs comprising no more than five steps.

* * * * *